United States Patent [19]

Long et al.

[11] Patent Number: 4,502,817

[45] Date of Patent: Mar. 5, 1985

[54] AIR INLET VALVE FOR UNDERWATER DIVER'S DRY SUIT

[75] Inventors: Richard W. Long; Robert T. Stinton, both of San Diego, Calif.

[73] Assignee: Diving Unlimited International, Inc., San Diego, Calif.

[21] Appl. No.: 372,626

[22] Filed: Apr. 28, 1982

[51] Int. Cl.[3] ..... B63C 11/08

[52] U.S. Cl. ..... 405/186; 128/201.27; 441/96

[58] Field of Search ..... 405/185, 186, 187; 2/2.1 R; 128/201.27, 201.28; 441/90, 92, 96

[56] References Cited

U.S. PATENT DOCUMENTS

| | | | |
|---|---|---|---|
| 3,107,373 | 10/1963 | Mellon et al. | 128/201.27 X |
| 4,045,835 | 9/1977 | Flam et al. | 405/186 X |
| 4,182,324 | 1/1980 | Hills | 128/201.27 |
| 4,379,656 | 4/1983 | Darling | 405/186 |

*Primary Examiner*—David H. Corbin

*Attorney, Agent, or Firm*—Brown, Martin & Haller

[57] ABSTRACT

An air inlet valve for an underwater diver's dry suit including a restricted opening in the air inlet coupling on the air inlet hose whereby the air inlet hose acts as a plenum chamber. A valve member is opened to pass the air in the inlet hose to the interior of the suit with a burst. Due to the restricted opening, air can be exhausted from the suit faster than it is introduced and thus avoiding a blow up in the suit, thereby bringing the diver to the surface causing a serious accident.

6 Claims, 4 Drawing Figures

AIR INLET VALVE FOR UNDERWATER DIVER'S DRY SUIT

BACKGROUND OF THE INVENTION

The present invention relates to an air inlet valve for an underwater diver's dry suit.

There are basically two types of suits for underwater diving. These are wet suits and dry suits. Wet suits permit a layer of water to form on the diver's skin inside the suit. Dry suits are used in colder surroundings and must avoid the entrance of water into the interior of the suit. Air is provided on the interior of the suit to form an insulating effect. Dry suits are used when diving in cold water.

The air inlet valve on the standard dry suit is always mounted on the outside of the suit. These valves are mechanical valves with a pushbutton in the center to actuate the valve. Air is supplied at a pressure of about one-hundred pounds per square inch above ambient. The diver must press a button against the suit in order to bring air into the suit. This is often difficult to do because the buoyancy compensators and the harness work on the outside of the suit make it difficult to locate and operate the valve mechanism.

The conventional exhaust valves vent air out either by manual operation or automatically if there is excessive air pressure in the suit. If the air inlet valve should malfunction and freeze in the open position, air continuously enters the interior of the suit. None of the exhaust valves currently available on the market will vent air out of the suit as fast as air is introduced into the suit. When over-pressure occurs inside the suit, the exhaust valve is lifted off the seat letting air escape into the surrounding water. However, it cannot exhaust the air rapidly enough to solve the problem.

SUMMARY OF THE INVENTION

The disadvantages of the prior arrangements are overcome by an exemplary embodiment of the present invention including plenum chamber means formed in the air supply hose by air restriction means whereby an initial burst of air is generated from the plenum chamber means when the inlet valve is opened. The air restriction means prohibits inlet of air faster than it can be exhausted by the exhaust valve if the inlet valve sticks open.

DETAILED DESCRIPTION OF THE INVENTION

Figure 1:
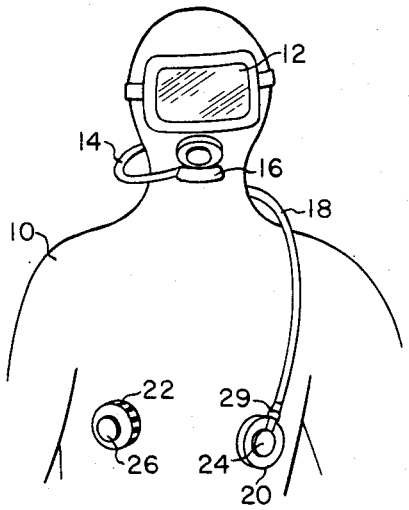
FIG. 1 PRIOR ART
FIG. 1 is a partial front view of an underwater diver wearing a dry suit with a conventional air inlet valve affixed on the surface of the suit.

Referring to the drawings, an underwater diver is shown in FIG. 1 wearing a dry suit 10 and face mask 12. An air inlet line 14 extends to the diver's breathing apparatus 16 from a source of air which is a pressurized air tank (not shown) on the diver's back or on a boat on the surface of the water. Another air line 18 extends to the air inlet valve 20 affixed to the dry suit 10. An air exhaust valve 22 is also affixed to the suit 10. The exhaust valves shown are the conventional mechanical valves. The air inlet valve 20 includes a button 24 which is pressed by the diver to cause air from the tank to enter the suit 10. The air supply to the interior of the suit is generally about one-hundred pounds per square inch above ambient. It is usually taken from a source of greater pressure such as two thousand pounds per square inch for example and reduced through a regulator (not shown). The exhaust valve 22 includes the pushbutton 26 which is pressed by the diver to exhaust air from the interior of the suit 10. The diver is normally wearing additional apparatus, such as a harness, which is not shown for the purpose of clarity in depicting the valves.

Figure 3:
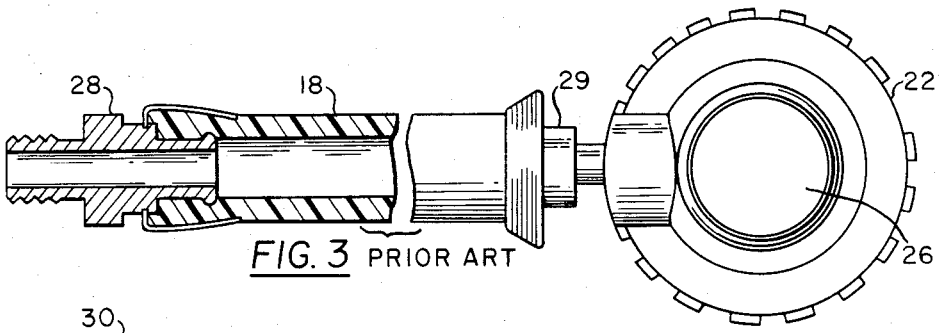
FIG. 3 PRIOR ART
FIG. 3 is a front elevation, partly sectioned, of the conventional air inlet valve shown in FIG. 1 of the drawings.

FIG. 3 shows the conventional air inlet valve 22 connected to air inlet line 18 with a threaded fitting 28 which connects with the pressure regulator or other device feeding air into the line. A quick disconnect fitting is shown at 29.

Figure 2:
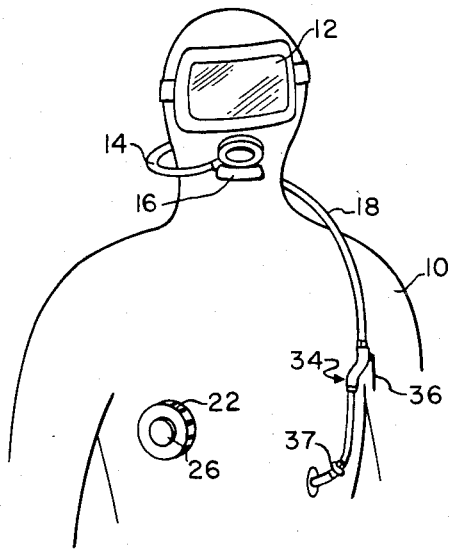
FIG. 2 is a partial front view of a diver wearing a dry suit with the air inlet valve of the present invention positioned in the air inlet line.
Figure 4:
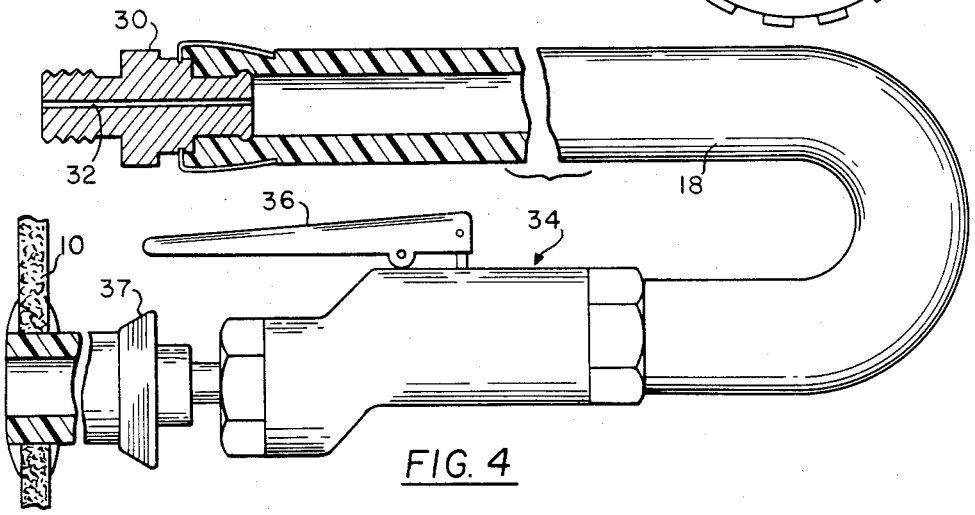
FIG. 4 is a front elevation, partly sectioned, of the ar inlet valve of the present invention positioned in the air inlet line.

The air inlet valve of the present invention is shown in FIGS. 2 and 4 of the drawings. The other equipment, including the exhaust valve 26, is the same as shown with respect to the conventional system. The air inlet valve is completely different.

The fitting 30 at the air supply end of air line 18 includes a restricted passage 32. Air from the air supply passes slowly through this restricted passage 32 until the air line 18 is filled with air at about one-hundred pounds per square inch pressure above ambient. Although a passage is shown in the drawings, an orifice can be used. A manually operated air inlet valve of conventional construction is shown at 34. The handle 36 is pressed when the diver desires to bring air into the interior of the suit 10. The inlet valve 34 is connected to the suit through a quick connect fitting 37. With this construction, when the diver presses the handle 36, the supply of air in the line 18 passes quickly with a burst into the suit. Additional air from the air supply is fed slowly at a controlled rate through the restricted passage 32. Air is brought into the suit at a slower rate than it can be exhausted. Thus, if the valve 34 freezes in the open position, the diver can exhaust air out the exhaust valve 22 from the interior of the suit 10 faster than it enters through the restricted passage 32 and he will not become over-pressurized or have a blow up in his suit. The air line 18 is thus used as a plenum chamber.

The air inlet valve of the present invention is simple and economical to manufacture. The diver can easily reach the air inlet valve and it is easy to operate. It provides a safety feature without adding mechanical parts which can malfunction.

Having thus described our invention, we claim:

1. A safety valve system for controlled inflation and deflation of a diver's suit, comprising:

a suit which provides a sealed interior when worn by a diver;

first manually actuable valve means connected to the interior of the suit and selectively openable for exhausting air completely out of the suit at a first predetermined rate;

a source of compressed air at a predetermined pressure;

an air line connected at one end to the source of compressed air;

restricting means having one end connected to the other end of the air line for limiting the flow of air therethrough to a second predetermined rate which is less than the first predetermined rate;

plenum means connected at one end to the other end of the restricting means for storing a pressurized volume of air sufficient to provide substantial inflation of the suit; and second manually actuable valve means connected to the other end of the plenum means and to the interior of the suit and selectively openable for introducing the pressurized volume of air in the plenum means into the suit in a burst to permit controlled inflation of the suit;

whereby if the second valve means malfunctions and remains open the first valve means may be manually opened to exhaust air from the suit faster than it can be introduced to prevent over-pressurization of the suit.

2. A safety valve system according to claim 1 wherein the first valve means includes a pushbutton actuator and the second valve means includes a handle actuator.

3. A safety valve system according to claim 1 and further comprising a coupling for connecting the second valve means to the interior of the suit to locate the second valve means away from the surface of the suit.

4. A safety valve system according to claim 3 wherein the coupling is a quick connect fitting.

5. A safety valve system according to claim 1 wherein the plenum means comprises a second air line.

6. A safety valve system according to claim 2 wherein the pushbutton is mounted on the surface of the suit.

* * * * *